US006325034B1

(12) United States Patent
Edelmayer

(10) Patent No.: US 6,325,034 B1
(45) Date of Patent: Dec. 4, 2001

(54) HYDRAULIC LASH ADJUSTER

(75) Inventor: Thomas C. Edelmayer, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/730,915

(22) Filed: Dec. 6, 2000

(51) Int. Cl.[7] ..... F01L 1/24
(52) U.S. Cl. ..... 123/90.43; 123/90.36; 123/90.46
(58) Field of Search ..... 123/90.36, 90.43, 123/90.46, 90.55, 90.57

(56) References Cited

U.S. PATENT DOCUMENTS 5,655,487 * 8/1997 Maas et al. ..... 123/90.16
5,875,748 * 3/1999 Haas et al. ..... 123/90.16
5,983,848 * 11/1999 Calka ..... 123/90.42

* cited by examiner

*Primary Examiner*—Weilun Lo
(74) *Attorney, Agent, or Firm*—L. J. Kasper

(57) ABSTRACT

A hydraulic lash adjuster (11) disposed within a bore (14) defined by an internal combustion engine (16), the hydraulic lash adjuster (11) comprising a ball plunger (12) including a body portion (13), whereby the body portion (13) is reciprocable in the bore (14) as said ball plunger (12) reciprocates between a relatively retracted position and a relatively extended position. The hydraulic lash adjuster (11) further comprising a leakdown plunger assembly (17) disposed within the body portion (13) and disposed downward in response to downward movement of the ball plunger (12) and said body portion (13). The leakdown plunger assembly (17) has a bottom portion (34) disposed toward a bottom (20) of the bore (14), to define a high pressure chamber (28). In the lash adjuster (11) of the invention, the ball plunger (12) and the body portion (13) comprise a single, integral, formed member. The body portion (13) defines an axial length (L) equal to a major portion of the entire axial length of the bore (14), and further defines an outside diameter (D) wherein the axial length (L) is from about 1.0 to about 1.4 times the outside diameter (D).

6 Claims, 3 Drawing Sheets

HYDRAULIC LASH ADJUSTER

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates generally to hydraulic lash adjusters for internal combustion engines, and more particularly, to a hydraulic lash adjuster (HLA) which is very compact in size, especially in overall length.

Although the present invention may be utilized in conjunction with hydraulic lash adjusters for use with a number of different types of engine valve gear train, the invention is especially advantageous when used in a valve gear train of the end-pivot rocker arm type, and will be described in connection therewith. When an HLA is used in an end-pivot rocker arm type of valve gear train, the HLA is stationary and is disposed in a bore formed in the engine cylinder head.

A conventional HLA of the type to which the invention relates includes an output plunger assembly engaging the rocker arm (in the case of an overhead cam engine) with the output plunger assembly typically being of either a one piece or a two piece construction. The plunger assembly includes a ball plunger element which engages a socket formed in the rocker arm, and a leakdown plunger element which defines a check valve seat and further defines a leakdown land, the leakdown plunger element being precisely fit within a bore of the body to provide a closely controlled fluid leakdown path during normal operation.

The above-described plunger assembly results in an overall HLA structure which is relatively long, such that it can be difficult to allocate sufficient space within the cylinder head to locate the HLA. The above-described problem is particularly acute in some of the new, compact, multi-valve engines. The length of conventional, prior art hydraulic lash adjusters can also cause constraints on other aspects of the design of the engine, such as valve location, valve angle, the location and orientation of the spark plug, and the location of oil galleries, coolant passages and valve ports.

BRIEF SUMMARY OF THE INVENTION

Accordingly, it is an object of the present invention to provide a hydraulic lash adjuster which is very compact, particularly in terms of its overall length.

It is a more specific object of the present invention to provide a hydraulic lash adjuster which effectively eliminates the traditional lash adjuster body, by providing a ball plunger which reciprocates directly within the bore formed in the cylinder head.

The above and other objects of the invention are accomplished by the provision of an improved hydraulic lash adjuster adapted to be disposed within a bore defined by an internal combustion engine, the hydraulic lash adjuster comprising a ball plunger including a body portion. The body portion is reciprocable in the bore as the ball plunger reciprocates between a relatively retracted position and a relatively extended position. The hydraulic lash adjuster firther comprises a leakdown plunger assembly disposed within the body portion and adapted to be disposed downward in response to downward movement of the ball plunger and the body portion. The leakdown plunger assembly has a bottom portion disposed toward a bottom of the bore, the plunger assembly and one of the bottom portion and the bottom of the bore cooperating to define a high pressure chamber.

The improved hydraulic lash adjuster is characterized by the ball plunger and the body portion comprising a single, integral formed member. The body portion defines an axial length equal to a major portion of the entire axial length of the bore and further defines an outside diameter wherein the axial length is from about 1.0 to about 1.4 times the outside diameter.

DETAILED DESCRIPTION OF THE PREFERRED EMBODIMENT

Figure 1:
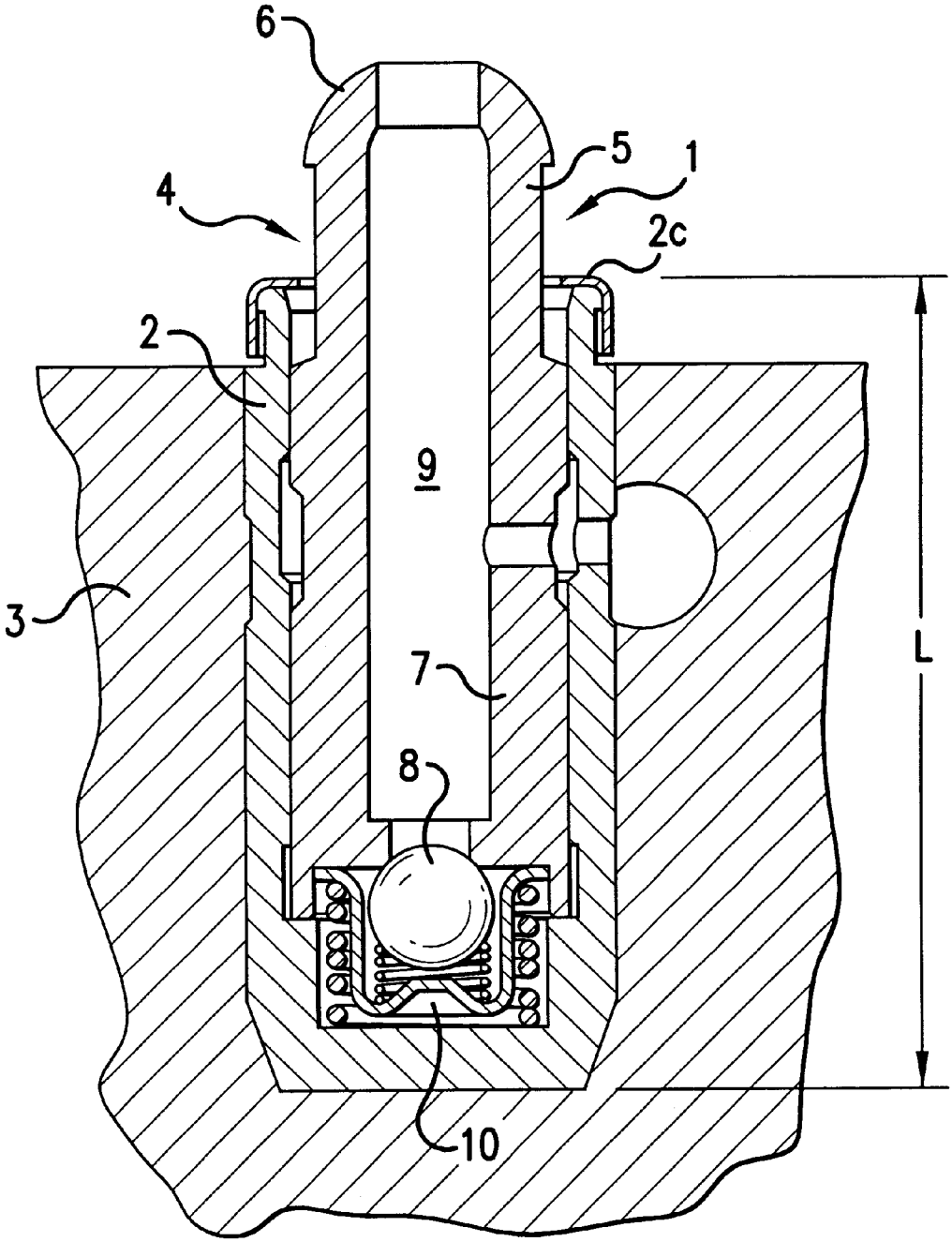
FIG.1 PRIOR ART
FIG. 1 is an axial cross-section of a typical prior art hydraulic lash adjuster.

Referring now to FIG. 1, there is illustrated a prior art hydraulic lash adjuster, generally designated by the numeral 1, comprising a body 2 which is received in a bore formed in a cylinder head 3 of an internal combustion engine. The HLA 1 includes a plunger assembly, generally designated 4, comprising a ball plunger 5 slidingly received within the body 2, and retained therein by a retainer cap 2*c*. The ball plunger 5 includes a ball end 6 engageable with a mating surface of a rocker arm (not shown in FIG. 1). The plunger assembly 4 further includes a leakdown plunger portion 7 (shown herein as being integral with the ball plunger 5), the leakdown plunger 7 being operable to permit oil flow only from a low pressure chamber 9, defined within the plunger 5, to a high pressure chamber 10, defined between the bottom of the leakdown plunger 7 and the bottom of the body 2.

In accordance with conventional practice, a very precisely controlled clearance exists between the body 2 and the leakdown plunger 7 to permit a precise amount of oil to leak therebetween during a valve operating cycle. Such a precisely controlled "leakdown flow" is required for effective operation of the HLA, in the "conventional leakdown" type of HLA shown in FIG. 1.

Figure 2:
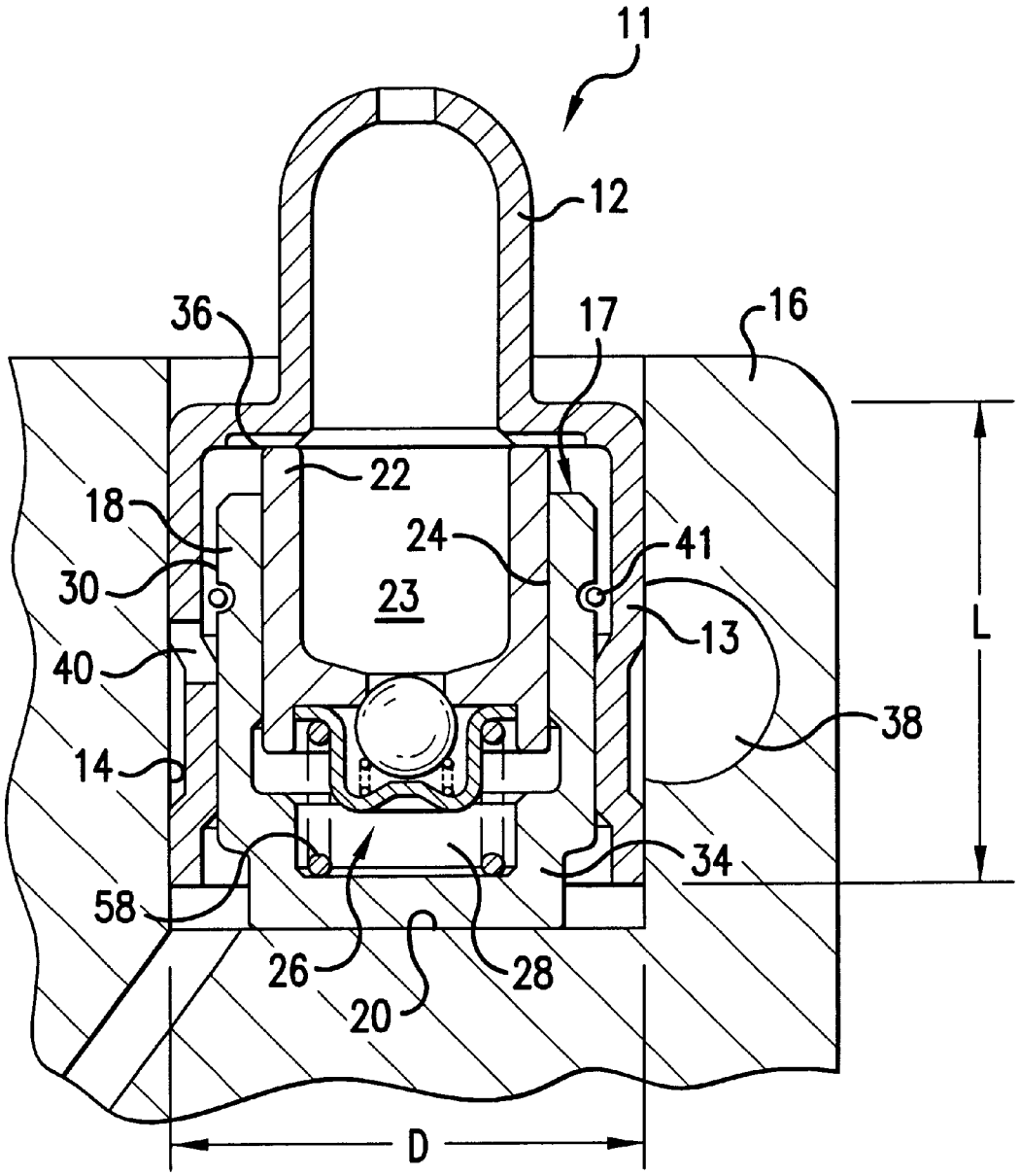
FIG. 2 is an axial cross-section of one embodiment of a hydraulic lash adjuster made in accordance with the present invention.

Referring now primarily to FIG. 2, there is illustrated an HLA, generally designated 11, and made in accordance with the present invention. In comparing FIG. 2 to FIG. 1, which are not necessarily shown on the same scale, it may be seen that while the HLA 11 may be somewhat larger in diameter than the prior art lash adjuster 1, the HLA 11 can be made significantly shorter in overall length. As is well know to those skilled in the art, the length which is of concern to engine designers is the length of the body of the HLA, designated "L" in each of FIGS. 1 and 2, the length L of the body in turn determining the axial length (or depth) of the bore (designated "14" in FIGS. 2 and 3) in which the HLA is disposed. The length L is the limiting factor with regard to the various engine design parameters noted previously, and as will be illustrated further in FIG. 3. The prior art HLA of FIG. 1, which had been commercialized and has been considered a very short lash adjuster, has a length L of 26.8 mm, while the HLA 11 of the present invention has a length L of 17.0 mm.

Figure 3:
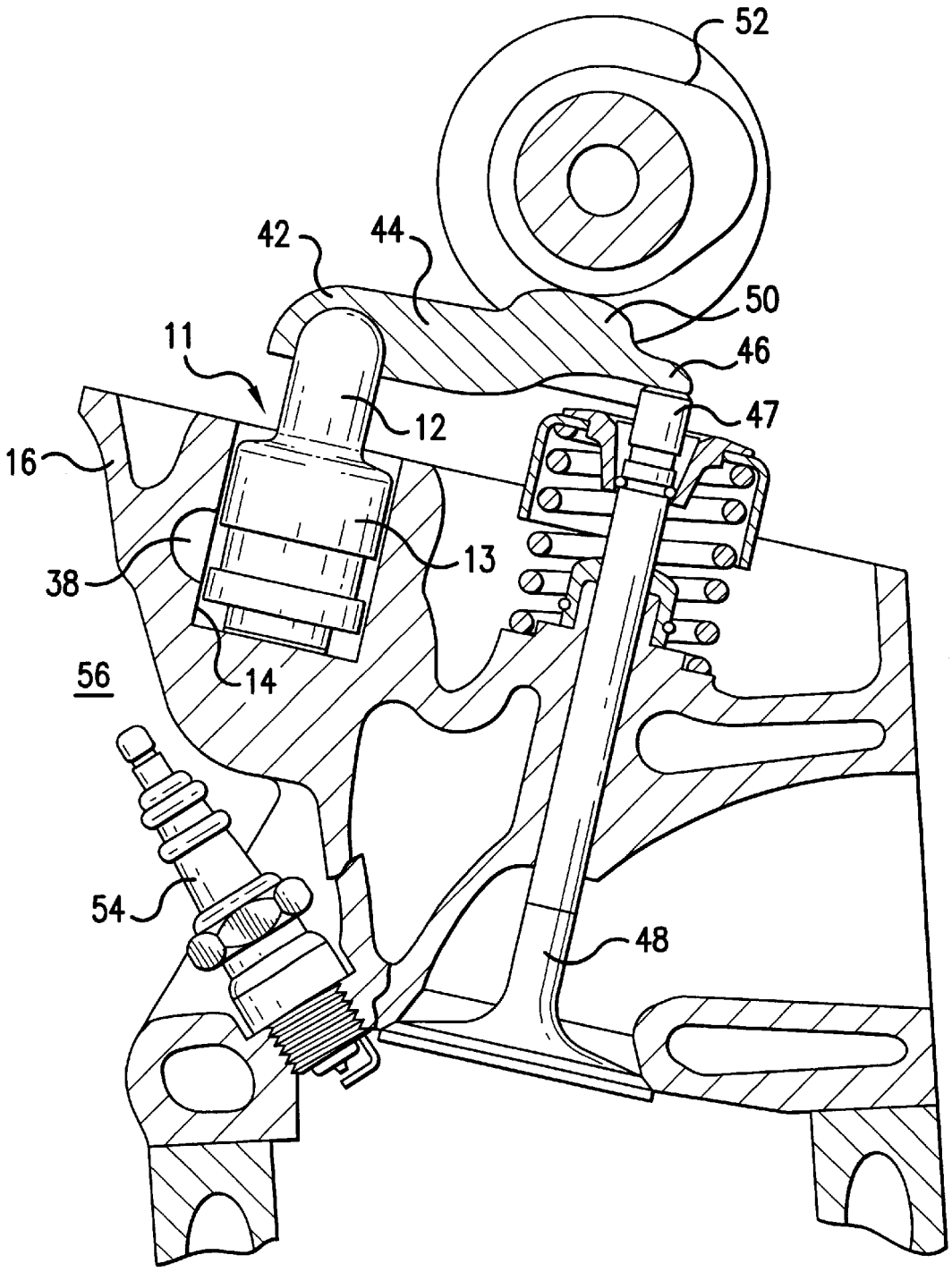
FIG. 3 is a fragmentary, axial cross-section, on a smaller scale than either FIG. 1 or FIG. 2, of a typical engine installation including the hydraulic lash adjuster of the present invention, as shown in FIG. 2.

Referring still to FIG. 2, but now in conjunction with FIG. 3, the HLA 11 comprises a ball plunger 12, which includes a "body portion" 13, the body portion 13 being received in sliding engagement within the bore 14 formed in a cylinder head 16. In accordance with one important aspect of the invention, the ball plunger 12 and the body portion 13 are preferably formed as a single, integral member. As used herein, the term "formed" will be understood to mean and include being made by a process such as stamping or deep drawing, or some other functionally equivalent, known, metal forming process which can provide a simple, inexpensive, relatively thin-walled member as shown in FIG. 2. Another example of a "formed" ball plunger 12 and body portion 13 would be one in which at least a portion of the ball plunger 12 is machined, while the body portion 13 is formed from a tubular member (or a stamped or drawn member), and then the ball plunger 12 is welded (friction welding or any other suitable welding process) to the upper end of the tubular body portion 13. The term "formed" will be understood not to include being made by a process in which a major portion of the surface of the member is machined, which would typically be substantially more time consuming and expensive.

In accordance with another important aspect of the present invention, a leakdown plunger assembly, generally designated 17, is slidingly disposed within the body portion 13. The leakdown plunger assembly 17 includes a sleeve 18 which is slidingly received within the body portion 13 of the ball plunger 12, and is engageable with a bottom 20 of the bore 14. A leakdown plunger 22 is slidingly received in a bore 24 formed in the sleeve 18, and a check valve assembly, generally designated 26, is received in a high pressure chamber 28 defined between the bottom of the leakdown plunger 22 and the bottom of the sleeve 18.

The sleeve 18 is a cup-like element having an outer diameter 30 in sliding engagement with an inner diameter of the body portion 13 of the ball plunger 12, and further having the blind, stepped bore 24. The bore 24 of the sleeve 18 cooperates with the plunger 22 to define a precision leakdown path, and a smaller diameter portion 34 of the sleeve 18 defines the lower extent of the high pressure chamber 28. A flat bottom surface of the sleeve 18 bears against the bottom 20 of the cylinder head bore 14. The ball plunger 12 includes, on its interior underside, a plurality of notches 36, which may take various forms, or alternatively, the upper surface of the plunger 22 may define such notches, the function of which will be described subsequently.

Referring again to FIG. 2 and FIG. 3 together, the cylinder head 16 defines a fluid passage 38, and lubricant fluid flows from the passage 38 through an opening 40 in the body portion 13 of the ball plunger 12. The lubricant fluid then flows upward between the body portion 13 and the sleeve 18, then through the notches 36 into a low pressure chamber or reservoir 23, the function of which is primarily to lubricate the interface between the outer surface of the ball plunger 12 and an adjacent surface of a rocker arm, as is well know to those skilled in the HLA art, which therefore will not be described in greater detail herein.

As is shown in FIGS. 2 and 3, the HLA 11 is not in its fully extended position, in which the volume of the high pressure chamber 28 would be at its maximum. Instead, the ball plunger 12 is only partially extended. Disposed about the outside of the sleeve 18 is a snap ring 41 which, if the ball plunger 12 were fully extended, would engage the interior shoulder of the body portion 13 (i.e., the shoulder which intersects the opening 40. Thus, upward movement (toward an extended position) of the ball plunger 12 is limited by the snap ring 41.

Referring now primarily to FIG. 3, the ball plunger 12 is received within a hemispherical socket 42 of a rocker arm 44. At the opposite end of the rocker arm from the socket 42 there is a valve contacting pad 46, the underside of which is in engagement with a tip 47 of an engine poppet valve 48. The rocker arm 44 also includes a cam follower portion 50, which is in engagement with a valve actuating cam 52, all of which is well known to those skilled in the art, is not essential to the invention, and will not be described further herein.

As will be understood by those skilled in the art, the cross-section shown in FIG. 3 through the cylinder head 16 is taken on two different planes, one being the plane containing the axes of the HLA 11 and of the engine poppet valve 48. The other plane shown fragmentarily in FIG. 3 is the one taken on the axis of a spark plug 54, which is inserted into the cylinder head through a passage or opening, generally designated 56. In accordance with one important aspect of the invention, but by way of example only, the passage 56 is disposed very close to the bottom of the bore 14 in which the HLA 11 is disposed. Those skilled in the art will understand that if the prior art HLA shown in FIG. 1 were to be used in the cylinder head 16 shown in FIG. 3, the bore required for the prior art HLA would require a reconfiguration of the passage 56, thus limiting the ability of the engine designer to locate and orient the spark plug 54. In some engine configurations, the HLA of the present invention would make it possible to have air flow passages to and from the intake and exhaust ports which are relatively straighter (rather than including a nearly ninety degree bend), thus increasing flow velocity and improving combustion.

As is well known to those skilled in the art of engine valve trains, the purpose of the hydraulic lash adjuster 11 is to compensate for changes in the "lash" of the valve train, which occurs in response to changes in temperature, etc. During operation, as the engine poppet valve 48 gets hotter, and its length increases, the length of the HLA 11 must decrease. Thus, as the socket 42 exerts a downward force on the ball plunger 12, it is forced downward in FIG. 2 from the partially extended position shown, forcing the leakdown plunger 22 downward also. As this downward movement occurs, the fluid pressure rises in the high pressure chamber 28, resulting in leakdown flow between the sleeve 18 and the leakdown plunger 22, in the manner described previously and as is well know to those skilled in the HLA art. This leakdown flow permits additional downward movement of the ball plunger 12 and the leakdown plunger 22.

If there is subsequently occasion for the HLA to increase in length, such as when the poppet valve 48 cools somewhat, the leakdown plunger 22, and in turn, the ball plunger 12 are biased upwardly by a compression spring 58. The upward movement of the plungers 12 and 22 results in a decrease in pressure in the high pressure chamber 28, until the pressure in the chamber 28 is less than that in the reservoir 23. When such a change in the relative pressures occurs, the check valve assembly 26 opens and permits fluid to flow from the reservoir 23 into the high pressure chamber 28, to keep the chamber 28 full of fluid.

Although the HLA 11 of the present invention includes three major parts, the construction of the invention eliminates the need for the retainer cap 2*c* of the prior art device. In addition, it is believed that the relatively shorter plungers and sleeve which comprise the present invention can be manufactured more simply, and therefore less expensively, than the relatively longer major components of the prior art device. Also, as was noted previously, the member comprising the ball plunger portion 12 and the body portion 13 preferably comprises a simple, inexpensive formed member whereas the body 2 and the ball plunger 5 of the prior art HLA comprise more complex, expensive machined members. Partly as a result, it would be relatively simple and economical to create an entire "family" of hydraulic lash adjusters having various diameters and lengths and ball end (ball plunger) configurations, all using a common hydraulic capsule (i.e., sleeve 18 plus plunger 22).

However, as was noted previously, the primary benefit of the present invention is the substantial reduction in overall length L which is possible. As is shown in FIG. 2, the body portion 13 defines an outside diameter D which is, of course, substantially identical to the diameter of the bore 14. Preferably, although not essential to the invention, the overall length L of the body portion 13 is in the range of about 1.0 to about 1.4 or 1.5 times the outside diameter D. The defined relationship will make it possible to have sufficient "bearing" area so that the ball plunger 12 does not cock within the bore 14, but will still permit the overall length of the HLA 11 to be extremely short. Preferably, the axial length L of the body portion 13 is equal to a major portion of the entire axial length of the bore 14, as is shown in FIG. 2, i.e., very little of the axial length of the bore 14 is "wasted". With the present invention, it now becomes relatively simple to design and manufacture a hydraulic lash adjuster in which the body portion has an axial length no greater than about 20.0 mm., such that the axial length of the bore in the cylinder head does not need to be any more than about 22.0 or 23.0 mm.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic lash adjuster adapted to be disposed within a bore defined in an internal combustion engine, said hydraulic lash adjuster comprising a ball plunger including a body portion, whereby said body portion is reciprocable in said bore as said ball plunger reciprocates between a relatively retracted position and a relatively extended position; said hydraulic lash adjuster further comprising a leakdown plunger assembly disposed within said body portion and adapted to be disposed downward in response to downward movement of said ball plunger and said body portion; said leakdown plunger assembly having a bottom portion disposed toward a bottom of said bore, said plunger assembly and one of said bottom portion and said bottom of said bore cooperating to define a high pressure chamber; characterized by:

(a) said ball plunger and said body portion comprising a single, integral, formed member; and (b) said body portion defines an axial length equal to a major portion of the entire axial length of said bore, and further defines an outside diameter wherein said axial length is from about 1.0 to about 1.4 times said outside diameter.

2. A hydraulic lash adjuster as claimed in claim 1, characterized by said plunger assembly comprising a sleeve member slidingly disposed within said body portion, and a leakdown plunger slidingly disposed within said sleeve member.

3. A hydraulic lash adjuster as claimed in claim 2, characterized by said sleeve member including said bottom portion, and said leakdown plunger and said bottom portion cooperating to define said high pressure chamber.

4. A hydraulic lash adjuster as claimed in claim 1, characterized by said ball plunger and said body portion comprising an integral stamped member.

5. A hydraulic lash adjuster as claimed in claim 1, characterized by said ball plunger and said body portion comprising an integral deep drawn member.

6. A hydraulic lash adjuster as claimed in claim 1, characterized by said axial length of said body portion is no greater than about 20.0 mm.

* * * * *